United States Patent [19]

Katafuchi et al.

[11] Patent Number: 4,832,860

[45] Date of Patent: May 23, 1989

[54] LUBRICATING OIL FOR METAL WORKING

[75] Inventors: Tadashi Katafuchi, Ichihara; Hiroo Mitazaki, Omiya; Seiichi Shido, Kisarazu; Yasunori Tomari; Kenji Onodera, both of Ichihara, all of Japan

[73] Assignee: Idemitsu Kosan Company Limited, Tokyo, Japan

[21] Appl. No.: 224,271

[22] Filed: Jul. 25, 1988

Related U.S. Application Data

[63] Continuation-in-part of Ser. No. 014,931, Feb. 13, 1987.

[30] Foreign Application Priority Data

Mar. 3, 1986 [JP] Japan ..... 61-44244

[51] Int. Cl.[4] ..... C10M 129/70; C10M 129/72; C10M 129/95

[52] U.S. Cl. ..... 252/56 R; 72/42

[58] Field of Search ..... 252/56 R; 72/42

[56] References Cited

U.S. PATENT DOCUMENTS

| | | | |
|---|---|---|---|
| 1,993,737 | 3/1935 | Graves et al. | 252/56 R |
| 2,134,736 | 11/1938 | Reuter | 252/56 R |
| 3,396,111 | 8/1968 | Smith et al. | 252/52 R |
| 3,900,297 | 8/1975 | Michaels | 252/56 R |
| 4,155,861 | 5/1979 | Schmitt et al. | 252/56 S |
| 4,517,105 | 5/1985 | Laemmle et al. | 252/56 R |

FOREIGN PATENT DOCUMENTS

| | | | |
|---|---|---|---|
| 61-25496 | 10/1981 | Japan | 252/56 R |
| 0160396 | 9/1983 | Japan | 72/42 |
| 0199109 | 11/1984 | Japan | 72/42 |

*Primary Examiner*—William R. Dixon, Jr.
*Assistant Examiner*—Jerry D. Johnson
*Attorney, Agent, or Firm*—Frishauf, Holtz, Goodman & Woodward

[57] ABSTRACT

A lubricating oil for metal working comprises a base oil and a diester of a branched aliphatic dicarboxylic acid having from 12 to 28 carbon atoms and a straight chain aliphatic alcohol having from 1 to 6 carbon atoms. The lubricating oil is excellent in rolling properties and causes no heat scratching, and permits the production of rolled plates having good gloss. These properties are further improved by adding a monoester compound having from 13 to 48 carbon atoms to the above oil.

36 Claims, No Drawings

LUBRICATING OIL FOR METAL WORKING

This application is a continuation-in-part, of application Ser. No. 07/014,931 filed Feb. 13, 1987, now abandoned.

BACKGROUND OF THE INVENTION

The present invention relates to a lubricating oil for metal working and more particularly to a lubricating oil effectively usable in rolling, which is excellent in anti-heat scratching properties and also which can reduce rolling load and improve gloss of the rolled plates.

Metal working oils such as a rolling oil, a pressing oil, an extrusion oil, a drawing oil, a punching oil and a cutting oil are required to be excellent in the necessary properties. For rolling oils, in particular, it is required that (1) they are excellent in rolling properties; in other words, they can produce a high reduction in pressure at a low rolling load, (2) they cause no heat scratching under severe conditions, (3) they permit the production of rolled plates having good gloss, and so forth.

In order to obtain a rolling oil satisfying the above requirements, attempts to compound various diester compounds to the base oil have been made. U.S. Pat. No. 3,396,111, for example, discloses the diesters of unsaturated dibasic acids having a small carbon atom number, such as dilauryl maleate, and higher fatty acids.

Rolling oils containing the above diester compounds are satisfactory to a certain extent in respect of (1) and (2) above, but not in respect of (3). In fact, a rolling oil sufficiently satisfactory in all the above requirements (1) to (3) has not yet been obtained.

SUMMARY OF THE INVENTION

An object of the present invention is to provide a lubricating oil which is excellent in all the above items (1) to (3).

It has been found that the object can be attained by adding the diesters of branched aliphatic dicarboxylic acids having from 12 to 28 carbon atoms and straight chain aliphatic alcohols having from 1 to 6 carbon atoms, or the above diesters and monoesters having from 13 to 48 carbon atoms.

The present invention relates to a lubricating oil for metal working which comprises a base oil and from 0.5 to 40 percent by weight (wt%) based on the weight of a final product of a diester of a branched aliphatic dicarboxylic acid having from 12 to 28 carbon atoms and a straight chain aliphatic alcohol having from 1 to 6 carbon atoms. This is hereinafter referred to as the "first invention".

In addition, the present invention relates to a lubricating oil for metal working which comprises a base oil, from 0.5 to 40 wt% based on the weight of a final product of a diester of a branched aliphatic dicarboxylic acid having from 12 to 28 carbon atoms and a straight chain aliphatic alcohol having from 1 to 6 carbon atoms, and from 0.5 to 40 wt% based on the weight of a final product of a monoester compound having from 13 to 48 carbon atoms. This is hereinafter referred to as the "second invention".

DETAILED DESCRIPTION OF THE INVENTION

As the base oil for use in the present invention, mineral oils and/or synthetic oils are used. Representative examples of mineral oils are the lubricating oil fraction selected from naphthenic mineral oils, intermediate mineral oils, paraffinic mineral oils, and high aromatic components resulting from decomposition of the above mineral oils. Representative examples of synthetic oils are long chain alkylbenzenes, branched alkylbenzenes, polyolefin oils such as α-olefin oligomer and polybutene, alkylnaphthalene, ester oils (exclusive of diester of the formula (I) shown hereinafter) and polyglycol oils. Of these oils, mineral oils having a dynamic viscosity at 40 degree centigrade (°C.) of from 1 to 30 centistokes (cst), especially from about 5 to 20 cst are preferred.

In the first invention, to these above base oil there is added the reaction products (diesters) of branched aliphatic dicarboxylic acids having from 12 to 28 carbon atoms and straight chain aliphatic alcohols having from 1 to 6 carbon atoms. In the second invention, to the above base oil there is added the above diester and in addition monoester compounds having from 13 to 48 carbon atoms.

The branched aliphatic dicarboxylic acids having from 12 to 28 carbon atoms that are used in the present invention are represented by the following:

$$\mathrm{HOOC(CH_2)}_m\mathrm{CH}(\mathrm{CH_2})_l\mathrm{CH_3}-(\mathrm{CH_2})_n\mathrm{COOH} \quad (1)$$

wherein subscript l is 1–3, m is 0–5 and n is 6–18. Examples of the compounds are as follows:

$$\mathrm{HOOC.CH}(\mathrm{CH_2})_3\mathrm{CH_3}-(\mathrm{CH_2})_{13}\mathrm{COOH}, \quad (2)$$

$$\mathrm{HOOC(CH_2)_5}-\mathrm{CH}(\mathrm{CH_2CH_3})-(\mathrm{CH_2})_6\mathrm{COOH}$$

$$\mathrm{HOOC(CH_2)_5}-\mathrm{CH}(\mathrm{CH_2CH_3})-(\mathrm{CH_2})_{10}\mathrm{COOH},$$

$$\mathrm{HOOC(CH_2)_5}-\mathrm{CH}(\mathrm{CH_2CH_3})-(\mathrm{CH_2})_{14}\mathrm{COOH}$$

$$\mathrm{HOOC(CH_2)}_p-\mathrm{CH}(\mathrm{CH_3})-(\mathrm{CH_2})_q-\mathrm{CH}(\mathrm{CH_3})-(\mathrm{CH_2})_r-\mathrm{COOH}$$

wherein subscripts p and r is 6 or 7 and subscript q is 2–4. Examples of the compounds are as follows:

$$\mathrm{HOOC(CH_2)_6CH}(\mathrm{CH_3})-(\mathrm{CH_2})_4.\mathrm{CH}(\mathrm{CH_3})-(\mathrm{CH_2})_6\mathrm{COOH} \quad (3)$$

$$\mathrm{HOOC(CH_2)_6CH}(\mathrm{CH_3})-(\mathrm{CH_2})_3-\mathrm{CH}(\mathrm{CH_3})-(\mathrm{CH_2})_7\mathrm{COOH}$$

$$\mathrm{HOOC(CH_2)_7CH}(\mathrm{CH_3})-(\mathrm{CH_2})_2-\mathrm{CH}(\mathrm{CH_3})-(\mathrm{CH_2})_7\mathrm{COOH}$$

$$\mathrm{HOOC(CH_2)_5CH}(\mathrm{CH=CH_2})-\mathrm{CH_2}(\mathrm{CH_2}-\mathrm{CH=CH}-\mathrm{CH_2})_s(\mathrm{CH_2})_5\mathrm{COOH}$$

wherein subscript s is 0–2. Examples of the compounds are as follows:

$$HOOC(CH_2)_5CH(CH=CH_2)-(CH_2)_6COOH \quad HOOC(CH_2)_5CH(CH=CH_2)-(CH_2)_2-CH=CH-(CH_2)_6COOH \tag{4}$$

$$HOOC(CH_2)_5-CH(CH=CH_2)-(CH_2)_2-CH=CH-(CH_2)_2-CH=CH-(CH_2)_6COOH$$

$$HOOC(CH_2)_5-(CH_2-C(CH_3)=CH-CH_2)_t.(CH_2-CH=C(CH_3)-CH_2)_u.(CH_2-C(CH_3)=CH-CH_2)_v-(CH_2)_5COOH$$

wherein subscripts t, u and v are 0–2 and $t+u+v=2$. Examples of the compounds are as follows:

$$HOOC(CH_2)_6-C(CH_3)=CH-(CH_2)_2CH=C(CH_3)-(CH_2)_6COOH$$

$$HOOC(CH_2)_6-C(CH_3)=CH-(CH_2)_2-C(CH_3)=CH-(CH_2)_6COOH$$

$$HOOC(CH_2)_6-CH=C(CH_3)-(CH_2)_2-C(CH_3)=CH-(CH_2)_6COOH$$

The number of carbon atoms contained in the branched aliphatic dicarboxylic acids is from 12 to 28, preferably from 14 to 24 and more preferably from 16 to 20. If the number of carbon atoms is less than 12, the anti-heat scratching properties are undesirably reduced. On the other hand, if the number of carbon atoms exceeds 28, the resultant composition is reduced in solubility particularly in a base oil having a low viscosity. It is necessary for the aliphatic dicarboxylic acids to be branched. Also the carbonyl groups are not bonded to the same carbon atom. These aliphatic dicarboxylic acids include both saturated and unsaturated dicarboxylic acids. Particularly preferred are saturated aliphatic dicarboxylic acids.

Straight chain saturated aliphatic dicarboxylic acids and straight chain unsaturated aliphatic dicarboxylic acids are unsuitable for use in the present invention because they decrease the solubility of the resultant composition and fail to produce the desired lubricating oil.

Additional examples of the branched aliphatic dicarboxylic acids are shown below.

(number of carbon atoms: 20)

$$HOOC.(CH_2)_5.CH(CH_2.CH_3).(CH_2)_{10}.COOH,$$

$$HOOC.(CH_2)_5.CH(CH=CH_2)(CH_2)_2.CH=CH.(CH_2)_6.COOH,$$

(number of carbon atoms: 16)

$$HOOC.(CH_2)_5.CH(CH_2.CH_3).(CH_2)_6.COOH,$$

$$HOOC.(CH_2)_5.CH(CH=CH_2).(CH_2)_6.COOH,$$

(number of carbon atoms: 12)

$$HOOC.CH((CH_2)_3.CH_3).(CH_2)_5.COOH$$

Straight chain aliphatic alcohols which are used in the present invention are ones having from 1 to 6 carbon atoms and preferably from 1 to 4 carbon atoms.

If branched aliphatic alcohols are used, the anti-heat scratching properties of the resultant composition are undesirably poor. Also, if the number of carbon atoms of the straight chain aliphatic alcohols is in excess of 6, the solubility is undesirably decreased. Representative examples of the straight chain aliphatic alcohols that are used in the present invention are $CH_3OH$, $C_2H_5OH$, n-$C_3H_7OH$ and n-$C_4H_9OH$.

In the present invention, the diesters obtained by reacting the above branched saturated or unsaturated aliphatic dicarboxylic acids having from 12 to 28 carbon atoms and those above straight chain aliphatic alcohols having from 1 to 6 carbon atoms are used.

The above diesters are compounded in an amount of from 0.5 to 40 wt%, preferably from 1 to 30 wt% based on the weight of a final product (lubricating oil).

If the amount of the above diester compounded is less than 0.5 wt%, the desired lubricating oil cannot be obtained. On the other hand, even if the diester is compounded in an amount exceeding 40 wt%, no additional effects can be obtained.

In the second invention, monoester compounds having from 13 to 48 carbon atoms are used in combination with the above diesters. If the above monoesters and diesters are used in combination, the anti-heat scratching preoperties are further improved, the rolling load can be decreased and further the gloss of the rolled plate is increased, as compared with the the use of diesters alone. Furthermore there can be obtained an advantage that the amount of the diester can be decreased by using the monoester in combination. It is desirable to use the monoester in combination with the diester when mineral oils or synthetic oils (exclusive of mono- and di-ester oils) are used as the base oil. Further, it is noted that the monoester used in the second invention should be a different compound then that compound which is used as the base oil.

The monoesters that are used in the present invention are represented by the general formula: RCOOR′ (wherein R is an alkyl group having from 12 to 22 carbon atoms and R′ is an alkyl group having from 1 to 26 carbon atoms). Although monoesters having from 13 to 48 carbon atoms can be used, monoesters having from 13 to 36 carbon atoms are preferably used. Preferred examples of the monoesters are shown below.

Methyl stearate ($C_{17}H_{35}COOCH_3$);
Butyl stearate ($C_{17}H_{35}COOC_4H_9$);
Octyl stearate ($C_{17}H_{35}COOC_8H_{17}$); and
Octyl palminate ($C_{15}H_{31}COOC_8H_{17}$).

Butyl stearate is particularly preferred because it is excellent in gloss property and is readily available.

The amount of the monoester compounded is from 0.5 to 40 wt%, preferably from 3 to 40 wt% based on the weight of a final product.

The lubricating oil for metal working of the present invention comprises the above components. If desired, auxiliary additives such as a viscosity index-improving agent, an anti-corrosion agent, an emulsifier, an antioxidant and a rust-preventing agent can be added to the lubricating oil for metal working of the present invention. The lubricating oil of the present invention is also useful as a lubricating oil for metal working, such as a pressing oil, an extrusion oil, a drawing oil, a punching oil and a cutting oil.

The lubricating oil of the first invention does not produce scratches on the surface of a steel plate, for example, which are called heat scratches, even under severe rolling conditions, and thus is excellent in anti-heat scratching properties.

The lubricating oil of the first invention permits rolling at low rolling load and thus is excellent in rolling properties.

The lubricating oil of the first invention permits the production of a rolled plate having good gloss.

The lubricating oil of the second invention produces a rolled plate having more improved gloss and is excellent in anti-heat scratching properties.

Accordingly the lubricating oil of the present invention can be used effectively as various lubricating oils for metal working, particularly as a lubricating oil for rolling.

The present invention is described in greater detail with reference to the following examples.

EXAMPLES 1 TO 12, AND COMPARATIVE EXAMPLES 1 TO 7

To a paraffinic mineral oil (8 cst at 40° C.) were added the predetermined amounts (wt%) of dibasic acid esters and monoesters shown in Table 1 to prepare lubricating oils.

Each lubricating oil was subjected to the rolling test in the manner as described below and evaluated for anti-heat scratching properties, the effect of reducing the rolling load and the gloss. The results are shown in Table 1.

Rolling Machine

Reversible 4-stage cold rolling machine (manufactured by No. 2 Yoshida Memorial Tekkojo Co., Ltd.)

Back up roll: 135ϕ×200 Wmm, 1.0μ Rmax

Work roll: 40ϕ×200 Wmm, 0.2μ Rmax

Test Coil

SUS304 stainless steel (annealed), 0.70×50×1 mm, 50 kg

Rolling Conditions

Rolling was performed at a tension of 350 kilograms (kg) under the conditions shown in the table below.

| Pass | Pressure Reduction Ratio (%) | Rolling Speed (m/min) | Tension (kg/mm²) Front | Tension (kg/mm²) Back |
|---|---|---|---|---|
| 1 | 23.7 | 30 | 13.1 | 10.0 |
| 2 | 18.2 | 30 | 16.0 | 13.1 |
| 3 | 19.9 | 100 | 20.0 | 16.0 |
| 4 | 22.9 | 100 | 25.9 | 20.0 |
| | 28.6 | 100 | 28.0 | 20.0 |
| | 34.3 | 100 | 30.4 | 20.0 |
| | 40.0 | 100 | 33.3 | 20.0 |
| | 45.7 | 100 | 36.8 | 20.0 |

Oil Feeding Conditions

Single side-recycling oil feeding such that the oil was fed to only each inlet of up and bottom rolls were performed under conditions that the oil temperature was 40° C., the amount of the oil fed was 10 liters per minute (l/min), the pressure of the oil fed was 0.5 kilogram per square centimeter (kg/cm²) and the amount of the oil in the tank was 30 liters (l).

Evaluation Methods

At a point that no heat scratches were produced when the thickness of the plate was decreased stepwise at predetermined intervals at the fourth pass (limiting strip thickness), the rolling load and the gloss were evaluated. The formation of heat scratches was examined with the eye. The gloss was determined based on a degree of gloss which was measured according to JIS Z8741 by the use of a Model GM-24 photometer (Gs: 45°; manufactured by Murakami Shikisai Gijutu Kenkyusho Co., Ltd.). The values of degree of gloss in the table below are each an average value of those of both sides, the front and the back.

Evaluation of Gloss (Degree of Gloss)

⊙: Very good (more than 650)

○: Good (600 to 650)

X: Bad (less than 600).

COMPARATIVE EXAMPLE 8

The same rolling test as in Example 1 was performed using a lubricating oil A on the market (which was prepared by adding a fatty acid type oil agent to a mineral oil). The results are shown in Table 1.

COMPARATIVE EXAMPLE 9

The same rolling test as in Example 1 was performed using a lubricating oil B on the market (which was prepared by adding an alcohol type oil agent to a mineral oil). The results are shown in Table 1.

TABLE 1

| | Dibasic Acid Ester Type* | Dibasic Acid Ester Amount | Butyl Stearate Amount | Fourth Pass Limiting Strip Thickness (mm) | Fourth Pass Rolling Load (tou) | Gloss |
|---|---|---|---|---|---|---|
| Example 1 | A | 5 | — | 0.203 | 14.7 | |
| Example 2 | A | 15 | — | 0.193 | 14.5 | |
| Example 3 | A | 30 | — | 0.190 | 14.0 | |
| Example 4 | B | 5 | — | 0.205 | 14.8 | |
| Example 5 | B | 15 | — | 0.198 | 14.5 | |
| Example 6 | B | 30 | — | 0.193 | 14.1 | |
| Example 7 | A | 5 | 10 | 0.185 | 13.8 | |
| Example 8 | A | 5 | 20 | 0.180 | 13.2 | |

TABLE 1-continued

| | Dibasic Acid Ester | | Butyl Stearate | Fourth Pass | | |
|---|---|---|---|---|---|---|
| | Type* | Amount | Amount | Limiting Strip Thickness (mm) | Rolling Load (tou) | Gloss |
| Example 9 | B | 5 | 10 | 0.187 | 13.8 | |
| Example 10 | B | 5 | 20 | 0.182 | 13.2 | |
| Example 11 | C | 15 | — | 0.195 | 14.6 | |
| Example 12 | C | 5 | 20 | 0.182 | 13.5 | |
| Comparative Example 1 | D | 15 | — | 0.250 | 16.8 | |
| Comparative Example 2 | E | 15 | — | 0.233 | 15.7 | |
| Comparative Example 3 | F | 15 | — | 0.230 | 15.5 | |
| Comparative Example 4 | G | 15 | — | 0.245 | 16.2 | |
| Comparative Example 5 | H | 15 | — | 0.255 | 17.2 | |
| Comparative Example 6 | A | 0.1 | — | 0.298 | 21.5 | X |
| Comparative Example 7 | — | — | 15 | 0.270 | 17.8 | |
| Comparative Example 8 | Lubricating Oil A (on the market) | | | 0.300 | 21.9 | X |
| Comparative Example 9 | Lubricating Oil B (on the market) | | | 0.267 | 17.1 | X |

*Dibasic acid esters
A: Diester of branched aliphatic dicarboxylic acid of the formula (II)

$$HOOC.(CH_2)_5.\underset{\underset{CH_2.CH_3}{|}}{CH}.(CH_2)_{10}.COOH \quad (II)$$

and methyl alcohol
B: Ester of aliphatic dicarboxylic acid of the formula (II) and butyl alcohol
C: Diester of branched aliphatic dicarboxylic acid of the formula (III)

$$HOOC.(CH_2).\underset{\underset{CH=CH_2}{|}}{CH}.(CH_2)_6.COOH \quad (III)$$

and methyl alcohol
D: Dioctyl sebacate
E: Diisodecyl adipate
F: Diester of trimellitic acid and 2-ethylhexyl alcohol
G: Diester of aliphatic dicarboxylic acid of the formula (II) and 2-ethylhexyl alcohol
H: Diester of aliphatic dicarboxylic acid of the formula (II) and isotridecyl alcohol

EXAMPLES 13 TO 19

To a synthetic oil were added the predetermined amounts (wt%) of dibasic acid esters and monoesters shown in Table 2 to prepare lubricating oils.

Each lubricating oil was subjected to the rolling test in the same manner as described in Example 1, and evaluated for anti-heat scratching properties, the effect of reducing the rolling load and the gloss. The results are shown in Table 2.

EXAMPLES 20 TO 31

To a paraffinic mineral oil were added the predetermined amounts (wt%) of dibasic acid esters and monoesters shown in Table 3 to prepare lubricating oils.

Each lubricating oil was subjected to the rolling test in the same manner as described in Example 1, and evaluated for anti-heat scratching properties, the effect of reducing the rolling load and the gloss. The results are shown in Table 3.

The Tables are—

TABLE 2

| | | Dibasic Acid Ester | | Butyl Stearate | Fourth Pass | | |
|---|---|---|---|---|---|---|---|
| Example | Base Oil*1 | Type*2 | Amount | Amount | Limiting Strip Thickness (mm) | Rolling Load (tou) | Gloss |
| 13 | I | A | 15 | — | 0.195 | 14.6 | |
| 14 | I | A | 5 | 20 | 0.182 | 13.5 | |
| 15 | II | A | 15 | — | 0.185 | 13.2 | |
| 16 | II | A | 5 | 20 | 0.178 | 13.2 | |
| 17 | III | A | 2 | — | 0.205 | 14.8 | |
| 18 | III | A | 15 | — | 0.190 | 14.1 | |
| 19 | III | A | 5 | 20 | 0.179 | 13.2 | |

*1Base Oil
I: α-Olefin oligomer (polyolefin oil) (8 cst at 40° C.)
II: Ester of trimethylol propane and coconut oil (ester oil) (19 cst at 40° C.)
III: 2-Ethyl hexyl palmitate (ester oil) (8 cst at 40° C.)
*2Dibasic acid ester
A: Diester of branched aliphatic dicarboxylic acid of the formula (II)

$$HOOC.(CH_2)_5.\underset{\underset{CH_2.CH_3}{|}}{CH}.(CH_2)_{10}.COOH \quad (II)$$

and methyl alcohol

TABLE 3

| Example | Base Oil viscosity at 40° C. | Dibasic Acid Ester Type*1 | Dibasic Acid Ester Amount | Monoester Type*2 | Monoester Amount | Fourth Pass Limiting Strip Thickness (mm) | Fourth Pass Rolling Load (ton) | Fourth Pass Gloss |
|---|---|---|---|---|---|---|---|---|
| 20 | 4 cSt | $A_1$ | 15 | — | | 0.197 | 14.7 | |
| 21 | 22 | $A_2$ | 15 | — | | 0.190 | 14.0 | |
| 22 | 12 | $A_3$ | 5 | — | | 0.204 | 14.5 | |
| 23 | 12 | $A_3$ | 15 | — | | 0.194 | 14.3 | |
| 24 | 12 | $A_3$ | 30 | — | | 0.191 | 14.0 | |
| 25 | 8 | $A_4$ | 15 | — | | 0.193 | 14.3 | |
| 26 | 4 | $A_1$ | 5 | $B_1$ | 10 | 0.190 | 14.0 | |
| 27 | 22 | $A_2$ | 5 | $B_2$ | 10 | 0.182 | 13.4 | |
| 28 | 12 | $A_3$ | 5 | $B_3$ | 10 | 0.186 | 13.7 | |
| 29 | 8 | $A_4$ | 5 | $B_4$ | 10 | 0.184 | 13.6 | |
| 30 | 8 | $A_5$ | 15 | — | | 0.193 | 14.2 | |
| 31 | 8 | $A_5$ | 5 | $B_4$ | 10 | 0.182 | 13.7 | |
| Comp. Ex. 10 | 8 | I | 15 | — | | 0.248 | 16.9 | |

*1Dibasic acid ester $A_1$: Diester of branched aliphatic dicarboxylic acid of the formula $$HOOC(CH_2)_5\underset{\underset{CH_2CH_3}{|}}{CH}(CH_2)_{14}COOH$$ and methyl alcohol $A_2$: Diester of branched aliphatic dicarboxylic acid of the formula $$HOOC(CH_2)_6\underset{\underset{CH_2CH_3}{|}}{CH}(CH_2)_6COOH$$ and n-butyl alcohol $A_3$: Diester of branched aliphatic dicarboxylic acid of the formula $$HOOC(CH_2)_6\underset{\underset{CH_3}{|}}{CH}(CH_2)_4\underset{\underset{CH_3}{|}}{CH}(CH_2)_6COOH$$ and n-butyl alcohol $A_4$: Diester of branched aliphatic dicarboxylic acid of the formula $$HOOC(CH_2)_6\underset{\underset{CH_3}{|}}{C}{=}CH(CH_2)_2CH{=}\underset{\underset{CH_3}{|}}{C}(CH_2)_6COOH$$ and methyl alcohol $A_5$: Diester of branched aliphatic dicarboxylic acid of the formula $$HOOC(CH_2)_5\underset{\underset{CH{=}CH_2}{|}}{CH}{-}CH_2{-}CH{=}CH{-}(CH_2)_6COOH$$

I: m-Decyl diethyl malonate

*2Monoester $B_1$: Oleyl behenate $B_2$: Methyl laurate $B_3$: Methyl oleate $B_4$: Butyl stearate

What is claimed is:

1. A lubricating oil for metal working which comprises mineral oils for synthetic oils having a dynamic viscosity at 40° C. of from 1 to 30 cst, and from 0.5 to 40% by weight based on the weight of a final product of a diester of a branched aliphatic dicarboxylic acid having from 16 to 28 carbon atoms and a straight chain aliphatic alcohol having from 1 to 4 carbon atoms, said dicarboxylic acid being selected from the group consisting of $$HOOC(CH_2)_m\underset{\underset{(CH_2)_lCH_3}{|}}{CH}{-}(CH_2)_nCOOH$$

wherein subscript l is 1–3, m is 0–5 and n is 6–18;

$$HOOC(CH_2)_p{-}\underset{\underset{CH_3}{|}}{CH}{-}(CH_2)_q{-}\underset{\underset{CH_3}{|}}{CH}{-}(CH_2)_r{-}COOH$$

wherein subscripts p and r is 6 or 7 and subscript q is 2–4;

$$HOOC(CH_2)_5\underset{\underset{CH{=}CH_2}{|}}{CH}{-}CH_2(CH_2{-}CH{=}CH{-}CH_2)_s(CH_2)_5COOH$$

wherein subscript s is 0–2; and $$HOOC(CH_2)_5{-}(CH_2{-}\overset{\overset{CH_3}{|}}{C}{=}CH{-}CH_2)_t.(CH_2{-}\overset{\overset{CH_3}{|}}{C}{=}CH{-}CH_2)_u.(CH_2{-}\overset{\overset{CH_3}{|}}{C}{=}CH{-}CH_2)_v{-}(CH_2)_5COOH$$

wherein subscripts t, u and v are 0–2 and $t+u+v=2$.

2. The lubricating oil as claimed in claim 1, wherein the aliphatic dicarboxylic acid is a saturated aliphatic dicarboxylic acid.

3. The lubricating oil of claim 1, wherein the dicarboxylic acid has 14 to 24 carbon atoms.

4. The lubricating oil of claim 1 wherein the dicarboxylic acid has 16 to 20 carbon atoms.

5. The lubricating oil of claim 1 containing 1 to 30% by weight of the diester.

6. The lubricating oil of claim 1 wherein the dicarboxylic acid is $$HOOC.(CH_2)_5.\underset{\underset{CH_2.CH_3}{|}}{CH}.(CH_2)_{10}.COOH,$$

or $$HOOC.(CH_2)_5.\underset{\underset{CH{=}CH_2}{|}}{CH}(CH_2)_2.CH{=}CH.(CH_2)_6.COOH,$$

7. The lubricating oil of claim 1 wherein the dicarboxylic acid is $$HOOC.(CH_2)_5.\underset{\underset{CH_2.CH_3}{|}}{CH}.(CH_2)_6.COOH,$$

or $$HOOC.(CH_2)_5.\underset{\underset{CH=CH_2}{|}}{CH}.(CH_2)_6.COOH,$$

8. The lubricating oil of claim 1 wherein the dicarboxylic acid is $$HOOC.\underset{\underset{(CH_2)_3.CH_3}{|}}{CH}.(CH_2)_5.COOH$$

9. The lubricating oil of claim 1 wherein the dicarboxylic acid is $$HOOC(CH_2)_m\underset{\underset{(CH_2)_lCH_3}{|}}{CH}-(CH_2)_nCOOH$$

wherein subscript l is 1–3, m is 0–5 and n is 6–18.

10. The lubricating oil of claim 1 wherein the dicarboxylic acid is $$HOOC.\underset{\underset{(CH_2)_3CH_3}{|}}{CH}-(CH_2)_{13}COOH,$$

$$HOOC(CH_2)_5-\underset{\underset{CH_2CH_3}{|}}{CH}-(CH_2)_6COOH$$

$$HOOC(CH_2)_5-\underset{\underset{CH_2CH_3}{|}}{CH}-(CH_2)_{10}COOH$$

Or $$HOOC(CH_2)_5-\underset{\underset{CH_2CH_3}{|}}{CH}-(CH_2)_{14}COOH,$$

11. The lubricating oil of claim 1 wherein the dicarboxylic acid is $$HOOC(CH_2)_p-\underset{\underset{CH_3}{|}}{CH}-(CH_2)_q-\underset{\underset{CH_3}{|}}{CH}-(CH_2)_r-COOH$$

wherein subscripts p and r is 6 or 7 and subscript q is 2–4.

12. The lubricating oil of claim 1 wherein the dicarboxylic acid is $$HOOC(CH_2)_6\underset{\underset{CH_3}{|}}{CH}-(CH_2)_4.\underset{\underset{CH_3}{|}}{CH}-(CH_2)_6COOH,$$

$$HOOC(CH_2)_6\underset{\underset{CH_3}{|}}{CH}-(CH_2)_3-\underset{\underset{CH_3}{|}}{CH}-(CH_2)_7COOH$$

Or $$HOOC(CH_2)_7\underset{\underset{CH_3}{|}}{CH}-(CH_2)_2-\underset{\underset{CH_3}{|}}{CH}-(CH_2)_7COOH.$$

13. The lubricating oil of claim 1 wherein the dicarboxylic acid is $$HOOC(CH_2)_5\underset{\underset{CH=CH_2}{|}}{CH}-CH_2(CH_2-CH=CH-CH_2)_s(CH_2)_5COOH$$

wherein subscript s is 0–2.

14. The lubricating oil of claim 1 wherein the dicarboxylic acid is $$HOOC(CH_2)_5\underset{\underset{CH=CH_2}{|}}{CH}-(CH_2)_6COOH \quad HOOC(CH_2)_5\underset{\underset{CH=CH_2}{|}}{CH}-(CH_2)_2-CH=CH-(CH_2)_6COOH \text{ Or}$$

$$HOOC(CH_2)_5-\underset{\underset{CH=CH_2}{|}}{CH}-(CH_2)_2-CH=CH-(CH_2)_2-CH=CH-(CH_2)_6COOH.$$

15. The lubricating oil of claim 1 wherein the dicarboxylic acid is $$HOOC(CH_2)_5-(CH_2-\overset{\overset{CH_3}{|}}{C}=CH-CH_2)_t.(CH_2-CH=\overset{\overset{CH_3}{|}}{C}-CH_2)_u.(CH_2-\overset{\overset{CH_3}{|}}{C}=CH-CH_2)_v-(CH_2)_5COOH$$

wherein subscripts t, u and v are 0–2 and $t+u+v=2$.

16. The lubricating oil of claim 1 wherein the dicarboxylic acid is $$HOOC(CH_2)_6-\underset{\underset{CH_3}{|}}{C}=CH-(CH_2)_2CH=\underset{\underset{CH_3}{|}}{C}-(CH_2)_6COOH,$$

$$HOOC(CH_2)_6-\underset{\underset{CH_3}{|}}{C}=CH-(CH_2)_2-\underset{\underset{CH_3}{|}}{C}=CH-(CH_2)_6COOH$$

Or $$HOOC(CH_2)_6-CH=\underset{\underset{CH_3}{|}}{C}-(CH_2)_2-\underset{\underset{CH_3}{|}}{C}=CH-(CH_2)_6COOH.$$

17. A lubricating oil for metal working which comprises mineral oils or synthetic oils having a dynamic viscosity at 40° C. of from 1 to 30 cst, and from 0.5 to 40% by weight based on the weight of a final product of a diester of a branched aliphatic dicarboxylic acid having from 16 to 28 carbon atoms and a straight chain aliphatic alcohol having from 1 to 4 carbon atoms, and from 0.5 to 40% by weight based on the weight of a final product of a monoester compound having from 19 to 36 carbon atoms, said dicarboxylic acid being selected from the group consisting of $$HOOC(CH_2)_mCH(CH_2)_lCH_3-(CH_2)_nCOOH$$

wherein subscript l is 1–3, m is 0–5 and n is 6–18;

$$HOOC(CH_2)_p-CH(CH_3)-(CH_2)_q-CH(CH_3)-(CH_2)_r-COOH$$

wherein subscripts p and r is 6 or 7 and subscript q is 2–4;

$$HOOC(CH_2)_5CH(CH=CH_2)-CH_2(CH_2-CH=CH-CH_2)_s(CH_2)_5COOH$$

wherein subscript s is 0–2; and $$HOOC(CH_2)_5-(CH_2-C(CH_3)=CH-CH_2)_t.(CH_2-CH=C(CH_3)-CH_2)_u.(CH_2-C(CH_3)=CH-CH_2)_y-(CH_2)_5COOH$$

wherein subscripts t, u and v are 0–2 and $t+u+v=2$.

18. The lubricating oil as claimed in claim 17, wherein the aliphatic dicarboxylic acid is a saturated aliphatic dicarboxylic acid.

19. The lubricating oil of claim 17, wherein the monoester compound has from 13 to 36 carbon atoms.

20. The lubricating oil of claim 17, wherein the monoester compound is methyl stearate.

21. The lubricating oil of claim 17, wherein the monoester compound is butyl stearate.

22. The lubricating oil of claim 17, wherein the monoester compound is octyl stearate.

23. The lubricating oil of claim 17, wherein the monoester is octyl palmitate.

24. The lubricating oil of claim 17 comprising 3 to 40% by weight of the monoester.

25. The lubricating oil of claim 17, comprising
1to 30% by weight of the diester and
3 to 40% by weight of the monoester.

26. The lubricating oil of claim 17 wherein the dicarboxylic acid is $$HOOC.(CH_2)_5.CH(CH_2.CH_3).(CH_2)_{10}.COOH,$$

or $$HOOC.(CH_2)_5.CH(CH=CH_2).(CH_2)_2.CH=CH.(CH_2)_6.COOH,$$

27. The lubricating oil of claim 17 wherein the dicarboxylic acid is $$HOOC.(CH_2)_5.CH(CH_2.CH_3).(CH_2)_6.COOH,$$

or

-continued $$HOOC.(CH_2)_5.CH(CH=CH_2).(CH_2)_6.COOH,$$

28. The lubricating oil of claim 17 wherein the dicarboxylic acid is $$HOOC.CH(CH_2)_3.CH_3.(CH_2)_5.COOH$$

29. The lubricating oil of claim 17 wherein the dicarboxylic acid is $$HOOC(CH_2)_mCH(CH_2)_lCH_3-(CH_2)_nCOOH$$

wherein subscript l is 1–3, m is 0–5 and n is 6–18.

30. The lubricating oil of claim 17 wherein the dicarboxylic acid is $$HOOC.CH(CH_2)_3CH_3-(CH_2)_{13}COOH,$$

$$HOOC(CH_2)_5-CH(CH_2CH_3)-(CH_2)_6COOH$$

$$HOOC(CH_2)_5-CH(CH_2CH_3)-(CH_2)_{10}COOH$$

Or $$HOOC(CH_2)_5-CH(CH_2CH_3)-(CH_2)_{14}COOH$$

31. The lubricating oil of claim 17 wherein the dicarboxylic acid is $$HOOC(CH_2)_p-CH(CH_3)-(CH_2)_q-CH(CH_3)-(CH_2)_r-COOH$$

wherein subscripts p and r is 6 or 7 and subscript q is 2–4.

32. The lubricating oil of claim 17 wherein the dicarboxylic acid is $$HOOC(CH_2)_6CH(CH_3)-(CH_2)_4.CH(CH_3)-(CH_2)_6COOH,$$

$$HOOC(CH_2)_6CH(CH_3)-(CH_2)_3-CH(CH_3)-(CH_2)_7COOH$$

Or $$HOOC(CH_2)_7CH(CH_3)-(CH_2)_2-CH(CH_3)-(CH_2)_7COOH.$$

33. The lubricating oil of claim 17 wherein the dicarboxylic acid is $$HOOC(CH_2)_5\underset{\underset{CH=CH_2}{|}}{CH}-CH_2(CH_2-CH=CH-CH_2)_s(CH_2)_5COOH$$

wherein subscript s is 0–2.

34. The lubricating oil of claim 17 wherein the dicarboxylic acid is $$HOOC(CH_2)_5\underset{\underset{CH=CH_2}{|}}{CH}-(CH_2)_6COOH,\quad HOOC(CH_2)_5\underset{\underset{CH=CH_2}{|}}{CH}-(CH_2)_2-CH=CH-(CH_2)_6COOH \text{ or}$$

$$HOOC(CH_2)_5-\underset{\underset{CH=CH_2}{|}}{CH}-(CH_2)_2-CH=CH-(CH_2)_2-CH=CH-(CH_2)_6COOH.$$

35. The lubricating oil of claim 17 wherein the dicarboxylic acid is $$HOOC(CH_2)_5-(CH_2-\overset{\overset{CH_3}{|}}{C}=CH-CH_2)_t\cdot(CH_2-$$

-continued $$-CH=\overset{\overset{CH_3}{|}}{C}-CH_2)_u\cdot(CH_2-\overset{\overset{CH_3}{|}}{C}=CH-CH_2)_y-(CH_2)_5COOH$$

wherein subscripts t, u and v are 0–2 and $t+u+v=2$.

36. The lubricating oil of claim 17 wherein the dicarboxylic acid is $$HOOC(CH_2)_6-\underset{\underset{CH_3}{|}}{C}=CH-(CH_2)_2CH=\underset{\underset{CH_3}{|}}{C}-(CH_2)_6COOH,$$

$$HOOC(CH_2)_6-\underset{\underset{CH_3}{|}}{C}=CH-(CH_2)_2-\underset{\underset{CH_3}{|}}{C}=CH-(CH_2)_6COOH$$

Or $$HOOC(CH_2)_6-CH=\underset{\underset{CH_3}{|}}{C}-(CH_2)_2-\underset{\underset{CH_3}{|}}{C}=CH-(CH_2)_6COOH.$$

* * * * *

UNITED STATES PATENT AND TRADEMARK OFFICE

CERTIFICATE OF CORRECTION

PATENT NO. : 4,832,860

DATED : May 23, 1989

INVENTOR(S) : KATAFUCHI et al

It is certified that error appears in the above-identified patent and that said Letters Patent is hereby corrected as shown below:

Column 10, claim 1, line 45, change "$CH_2)_y$" to -- $CH_2)_v$--.

Column 13, claim 17, line 29, change " $-CH_2)_y$" to -- $-CH_2)_v$--.

Column 16, claim 35, line 4, change "$(CH_2)_y$" to --$(CH_2)_v$--.

Signed and Sealed this

Fifth Day of May, 1992

*Attest:*

DOUGLAS B. COMER

*Attesting Officer*

*Acting Commissioner of Patents and Trademarks*